US011971046B2

(12) United States Patent
Welschinger

(10) Patent No.: US 11,971,046 B2
(45) Date of Patent: Apr. 30, 2024

(54) ROTARY PUMP FOR CONVEYING A FLUID

(71) Applicant: Sulzer Management AG, Winterthur (CH)

(72) Inventor: Thomas Welschinger, Radolfzell (DE)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 18/097,099

(22) Filed: Jan. 13, 2023

(65) Prior Publication Data

US 2023/0258196 A1 Aug. 17, 2023

(30) Foreign Application Priority Data

Feb. 11, 2022 (EP) ..... 22156326

(51) Int. Cl.

| | |
|---|---|
| ***F04D 29/12*** | (2006.01) |
| ***F04D 1/06*** | (2006.01) |
| ***F04D 29/041*** | (2006.01) |
| ***F04D 29/046*** | (2006.01) |

(52) U.S. Cl.

CPC ..... *F04D 29/126* (2013.01); *F04D 1/06* (2013.01); *F04D 29/041* (2013.01); *F04D 29/046* (2013.01)

(58) Field of Classification Search

CPC ..... F04D 29/126; F04D 1/06; F04D 29/041; F04D 29/046

See application file for complete search history.

(56) References Cited

U.S. PATENT DOCUMENTS

| | | | | |
|---|---|---|---|---|
| 5,531,564 A * | 7/1996 | Anttonen | F04D 29/049 | 416/198 A |
| 5,713,720 A * | 2/1998 | Barhoum | F04D 29/0416 | 415/107 |
| 8,133,007 B2 * | 3/2012 | Marcelli | F04D 29/0416 | 417/365 |
| 2010/0068031 A1 * | 3/2010 | Marcelli | F04D 1/066 | 415/104 |

FOREIGN PATENT DOCUMENTS

| | | |
|---|---|---|
| EP | 0667456 A1 | 8/1998 |
| EP | 2163767 A1 | 3/2010 |
| RU | 2623634 C1 | 6/2017 |

OTHER PUBLICATIONS

European Search Report issued Jul. 29, 2022 in corresponding European Application No. 22156326.5.

* cited by examiner

*Primary Examiner* — Eldon T Brockman
(74) *Attorney, Agent, or Firm* — GLOBAL IP COUNSELORS, LLP

(57) ABSTRACT

A rotary pump for conveying a fluid, includes a pump housing, a pump shaft, a hydraulic unit, a mechanical seal, and a stator. The hydraulic unit conveys and pressurizes the fluid, includes an impeller fixedly mounted on the pump shaft, and during operation generates an axial thrust to act on the pump shaft. The mechanical seal seals the pump shaft and includes a rotor connected to the pump shaft in a torque proof manner. The stator is stationary with respect to the pump housing. The mechanical seal is arranged between the hydraulic unit and an end of the pump shaft, and is a balancing device configured to generate an axial force on the pump shaft during operation, with the axial force configured to counteract the axial thrust.

17 Claims, 2 Drawing Sheets

ROTARY PUMP FOR CONVEYING A FLUID

CROSS-REFERENCE TO RELATED APPLICATION

This application claims priority to European Patent Application No. 22156326.5 filed Feb. 11, 2022, the contents of which are hereby incorporated by reference in their entirety.

BACKGROUND

Technical Field

The disclosure relates to a rotary pump for conveying a fluid.

Background Information

Conventional rotary pumps for conveying a fluid, for example a liquid such as water, can be used in many different industries. Examples are the oil and gas industry, the power generation industry, the chemical industry, the water industry or the pulp and paper industry. Rotary pumps have at least one impeller and a pump shaft for rotating the impeller. The impeller(s) can be configured, for example, as a radial impeller or as an axial or semi-axial impeller or as a helicoaxial impeller. Furthermore, the impeller can be configured as an open impeller or as a closed impeller, where a shroud is provided on the impeller, the shroud at least partially covering the vanes of the impeller.

SUMMARY

A rotary pump can be designed as a single stage pump having only one impeller mounted to the pump shaft or as a multistage pump comprising a plurality of impellers, wherein the impellers are arranged one after another on the pump shaft. The impellers can be arranged in an in-line arrangement, where the axial thrust generated by a single impeller is directed in the same direction for all impellers, or in a back-to-back arrangement, where the axial thrust generated by a first group of impellers is directed in the opposite direction as the axial thrust generated by a second group of impellers.

Many conventional rotary pumps are provided with at least one balancing device or balancing system for at least partially balancing the axial thrust that is generated by the impeller(s) during operation of the pump. The balancing device reduces the axial thrust that has to be carried by the axial bearing or the thrust bearing. The balancing device can comprise a balance disc or a balance drum for at least partially balancing the axial thrust that is generated by the rotating impellers.

A balance drum is fixedly connected to the pump shaft of the pump in a torque proof manner. In addition, the balance drum is also firmly connected to the pump shaft with respect to the axial direction, so that the balance drum cannot move along the pump shaft with respect to the axial direction. Usually, in a single stage pump or in a multistage pump with in-line arrangement of the impellers the balance drum is arranged at the discharge side of the pump between the last stage impeller and a shaft sealing device. In a multistage pump with a back-to-back arrangement of impellers the balance drum is usually located adjacent to an intermediate stage impeller, which is arranged at one end of the hydraulic unit comprising all the impellers. The balance drum defines a front side and a back side. The front side is the side facing the hydraulic unit. The back side is the side facing the shaft sealing device.

A relief passage is provided between the balance drum and a stationary part being stationary with respect to the pump housing. The back side is usually connected to the suction side or a low pressure location of the pump by means of a balance line. At the low pressure location a pressure prevails, which is smaller than the pressure at the front side. During operation there is a leakage flow through the relief passage from the front side along the balance drum to the back side and from there through the balance line to the suction side. At the front side of the balance drum the higher pressure or the discharge pressure prevails, and at the back side essentially the suction pressure or the low pressure prevails. The pressure difference between the front side and the back side results in an axial force which is directed in the opposite direction as the axial thrust generated by the rotating impeller(s). Thus, the axial thrust that has to be carried by the axial or thrust bearing is at least considerably reduced. The balance drum is secured to the pump shaft sufficiently strong, so that the axial force cannot move the balance drum relative to the pump shaft.

For configuring a balance drum, the axial thrust generated by the hydraulic unit during operation of the pump can be determined, calculated or estimated. The balance drum is then dimensioned such, in particular regarding the outer diameter, that the area of the axial face at the back side multiplied with the pressure difference over the balance drum at least approximately balances the axial thrust generated by the hydraulic unit.

Of course, the leakage flow along the balance drum results in a decrease of the hydraulic performance or efficiency of the pump. Therefore, the relief passage is usually configured such, that the leakage flow is low but still sufficient for generating the axial force counteracting the axial thrust generated by the impeller(s).

In many conventional applications the most efficient use of the pump is strived for. It is desirable to have the highest possible ratio of the power, especially the hydraulic power, delivered by the pump to the power needed for driving the pump. This desire is mainly based upon an increased awareness of environment protection and a responsible dealing with the available resources as well as on the increasing costs of energy. As already the, the flow of the fluid passing along the balance drum through the relief passage, which is in most cases the main leakage flow occurring in the pump, reduces the efficiency of the pump. In addition, the flow of the fluid through the relief passage causes a friction or drag loss, which can further reduce the overall efficiency of the pump Starting from this state of the art it is therefore an object of the disclosure to propose a rotary pump for conveying a fluid, having a reduced leakage flow through the balancing system and therewith an increased efficiency without reducing the balancing of the axial thrust acting on the pump shaft during operation of the pump.

The subject matter of the disclosure satisfying this object is characterized by the features described herein.

Thus, according to an embodiment of the invention, a rotary pump for conveying a fluid is proposed, comprising a pump housing with an inlet for receiving the fluid having a suction pressure, an outlet for discharging the fluid having a discharge pressure, a pump shaft configured for rotating about an axial direction, and a hydraulic unit for conveying and pressurizing the fluid, wherein the hydraulic unit comprises at least one impeller fixedly mounted on the pump shaft, and wherein during operation the hydraulic unit generates an axial thrust acting on the pump shaft, the pump further comprising a mechanical seal for sealing the pump shaft, wherein the mechanical seal has a rotor, which is connected with the pump shaft in a torque proof manner, and a stator, which is configured to be stationary with respect to the pump housing, and wherein the mechanical seal is arranged between the hydraulic unit and an end of the pump shaft. The mechanical seal is configured as a balancing device for generating an axial force on the pump shaft during operation, with the axial force counteracting the axial thrust.

In the rotary pump according to the disclosure the mechanical seal is configured as a balancing device, so that there is no need for a separate balance drum or a separate balance disc. The function of the balance drum or the balance disc in state of the art pumps is performed by the mechanical seal in the rotary pump according to the disclosure.

The mechanical seal, which is configured as a balancing device is firmly secured to the pump shaft with respect to the axial direction, for example in an analogous or similar way as it is known from a balance drum in a conventional pump, so that the axial force generated by the mechanical seal to counteract the axial thrust cannot move the rotor of the mechanical seal relative to the pump shaft in the axial direction.

In a similar manner as it is known from classical balance drums, the mechanical seal configured as a balancing device generates the axial force, which counteracts the axial thrust generated by the hydraulic unit, wherein the axial force, in most applications, does not completely compensate the axial thrust for practical reasons. Thus, there remains a residual force in the axial direction which has to be carried by the axial or thrust bearing. However, in the rotary pump according to the disclosure the mechanical seal can be configured such, that the residual force, i.e. the difference between the axial thrust generated by the hydraulic unit and the axial force generated by the mechanical seal, is at least not larger as compared to a conventional design with a balance drum. Thus, the load acting on the axial bearing is essentially the same as compared to a design with a conventional balance drum. It has to be noted, that the axial force generated by the mechanical seal can be adjusted such that the residual force is different from zero. In this case the residual force can be directed towards the hydraulic unit or in the opposite direction, i.e. away from the hydraulic unit.

Compared to a conventional balance drum the mechanical seal of the present disclosure which is configured as a balancing device has a considerably lower leakage flow. Of course, there is a very small leakage of the fluid between the rotor and the stator of the mechanical seal, however this leakage is considerably lower than the leakage flow along a conventional balance drum. By drastically reducing the leakage flow the overall efficiency of the rotary pump is remarkably increased. Concomitantly, the balancing of the axial thrust generated by the hydraulic unit can be maintained, so that there is no additional load acting on the trust bearings by replacing the conventional balance drum by the mechanical seal.

Furthermore, the extension of the rotary pump in the axial direction can be considerably reduced, because the conventional arrangement of a balance drum and a mechanical seal arranged adjacent to each other with respect to the axial direction, is replaced by the mechanical seal, only, wherein the mechanical seal fulfills both the balancing action and the sealing action. Since there is no need for a separate balance drum or balance disc beside the mechanical seal, the length of the rotary pump in the axial direction can be essentially reduced, which is an important advantage, for example with respect to the weight, the rotodynamic behavior and the cost of the rotary pump.

Preferably, the mechanical seal has a sealing diameter, which is configured for balancing the axial thrust generated by the hydraulic unit. As customary, the sealing diameter of the mechanical seal is the diameter of the midline of the counter running faces of the rotor and the stator. It is for example possible, to replace a conventional balance drum by the mechanical seal, wherein the sealing diameter of the mechanical seal has the same value as the diameter of the relief passage surrounding the conventional balance drum. By this measure the mechanical seal provides the same balancing action as the conventional balance drum.

In conventional configurations it is an object to make the sealing diameter of a mechanical seal as small as possible, i.e. to locate the annular seal face of the rotor as close as possible to the pump shaft, with respect to the radial direction. Thereby high reliability shall be achieved and for a given rotational speed of the pump shaft the sliding speed of the annular seal face of the rotor shall be minimized. Surprisingly, it turned out that the sealing diameter of the mechanical seal can be considerably increased without substantially reducing the reliability of the mechanical seal.

From a practical perspective it is preferred that the rotor comprises an rotor seal ring having an inner diameter which is at least 15 mm larger than the diameter of the pump shaft; preferably at least 20 mm larger, and particularly preferred at least 25 mm larger than the diameter of the pump shaft. The annular seal ring comprises the seal face of the rotor, which is the mating surface of the rotor that cooperates with the stator for providing the sealing action. The difference between the inner diameter of the rotor seal ring and the diameter of the pump shaft relates to the location where the rotor of the mechanical seal is arranged.

Furthermore, it is preferred that the mechanical seal has a sealing diameter, which is at least 15 mm larger than the diameter of the pump shaft, preferably at least 20 mm larger, and particularly preferred at least 25 mm larger than the diameter of the pump shaft. The difference between the sealing diameter and the diameter of the pump shaft relates to the location where the rotor of the mechanical seal is arranged.

Preferably, the mechanical seal is configured for sealing a pressure difference, which is at least as large as the difference between the discharge pressure and the suction pressure. By this measure it is at least approximately possible to use the entire pressure difference between the discharge pressure and the suction pressure for generating the axial force counteracting the axial thrust produced by the hydraulic unit.

According to a preferred embodiment the mechanical seal has a front side facing the hydraulic unit, and a back side facing away from the hydraulic unit, wherein the front side is arranged adjacent to an impeller of the hydraulic unit, such the front side of the mechanical seal is exposed to essentially the same pressure as a back side of the impeller. Thus, it is preferred that the mechanical seal is arranged directly adjacent to the hydraulic unit.

In particular, in embodiments, where the rotary pump is configured as a single stage pump or as a multistage pump with an in-line arrangement of the impellers, it is preferred that the front side of the mechanical seal is arranged for being exposed to a pressure, which is essentially the same as the discharge pressure.

Furthermore, it is preferred that the back side of the mechanical seal is arranged for being exposed to a pressure, which is essentially the same as the suction pressure, or an ambient pressure prevailing at the outside of the pump housing. Preferably the ambient pressure prevailing at the outside of the pump housing is the atmospheric pressure, i.e. the mechanical seal is configured for sealing against the atmosphere.

The ambient pressure is the pressure prevailing in the environment, where the rotary pump is located. i.e. the pressure prevailing at the outside of the pump housing. The ambient pressure can be the same as the atmospheric pressure. The suction pressure can equal or approximately equal the ambient pressure. Of course, it is also possible that the suction pressure substantially differs from the ambient pressure.

Different from a classical balance drum the mechanical seal configured as a balancing device still has the function to seal against the ambient pressure, for example the atmospheric pressure, i.e. the air pressure caused by the atmosphere. A classical balance drum is usually neither configured nor arranged for sealing against the ambient pressure such as the atmospheric pressure. In a classical balance drum arrangement the front side of the balance drum is exposed to a high pressure, for example the discharge pressure of the pump, whereas the back side of the balance drum is exposed to the internal suction pressure of the pump. Usually the backside of the balance drum is connected to the internal suction side of the pump by a balance line, so that the suction pressure prevails at the back side of the balance drum. In the arrangement the sealing against the ambient pressure is achieved by a sealing arrangement, which is a different device. The sealing arrangement, e.g. a mechanical seal, is usually arranged between the balance drum and the bearing(s) for the pump shaft.

It is another preferred measure that a disaster bushing is provided for restricting a leakage of the fluid through the mechanical seal in the event of a failure of the mechanical seal.

For many applications it is preferred that the rotary pump is configured as a multistage pump having a plurality of impellers.

In particular, the rotary pump can be configured with the hydraulic unit comprising at least a first stage impeller, and a last stage impeller, and optionally at least one intermediate stage impeller, with each impeller fixedly mounted on the pump shaft.

When the pump is configured as a multistage pump with an in-line arrangement of the impellers it is preferred that the mechanical seal is arranged adjacent to the last stage impeller with respect to the axial direction.

Preferably the mechanical seal is configured for sealing against the atmosphere. In this configuration the back side of the mechanical seal is exposed to the atmospheric pressure, i.e. the air pressure caused by the atmosphere outside the pump housing.

Further advantageous measures and embodiments of the invention will become apparent from the description herein.

BRIEF DESCRIPTION OF THE DRAWINGS

The invention will be explained in more detail hereinafter with reference to embodiments of the invention and with reference to the drawings.

DETAILED DESCRIPTION

Figure 1:
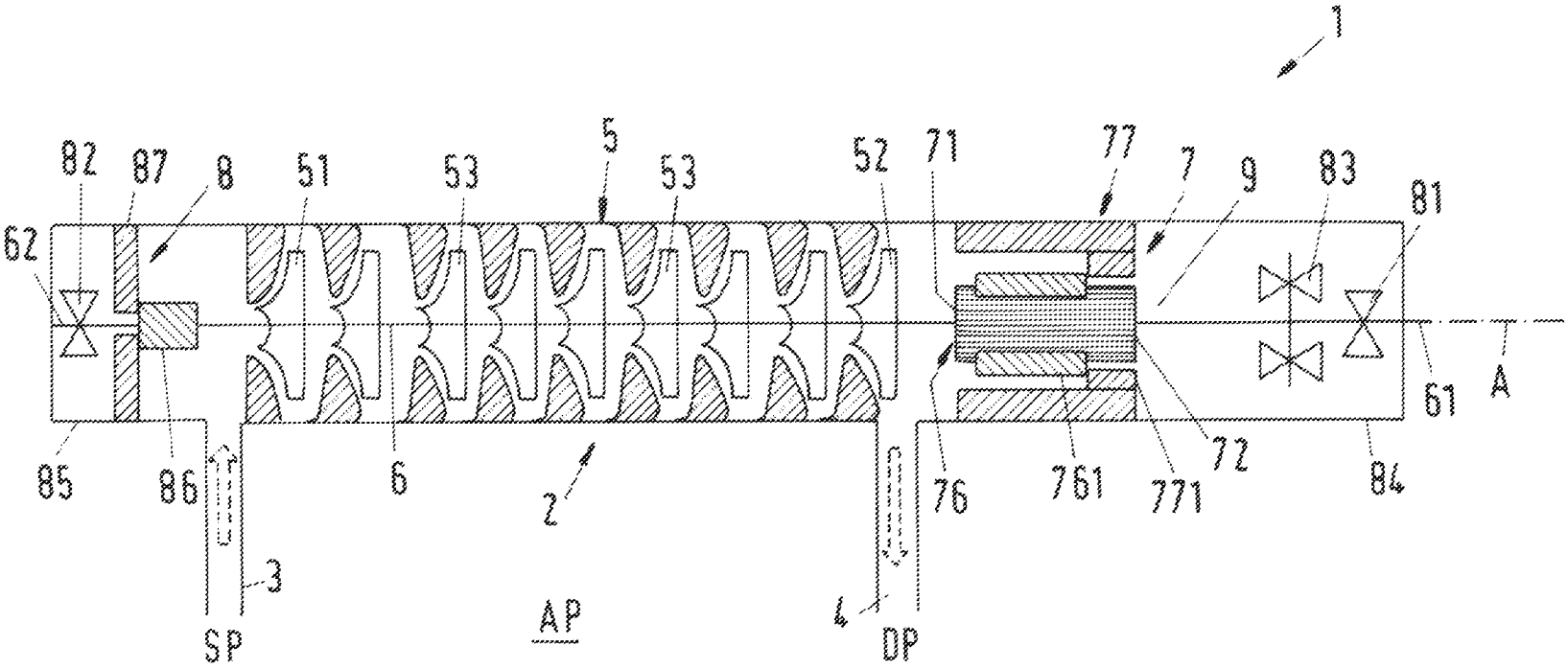
FIG. 1 is a schematic cross-sectional view of an embodiment of a rotary pump according to the invention.

FIG. 1 shows a schematic cross-sectional view of an embodiment of a rotary pump according to the disclosure, which is designated in its entity with reference numeral 1. The pump 1 is designed as a centrifugal pump for conveying a fluid, for example a liquid such as water.

The rotary pump 1 comprises a pump housing 2 having an inlet 3 and an outlet 4 for the fluid to be conveyed. The inlet 3 is arranged on a suction side and receives the fluid having a suction pressure SP. The outlet 4 is arranged on a discharge side and discharges the fluid having a discharge pressure DP, wherein the discharge pressure DP is larger than the suction pressure SP. The pump 1 further comprises a hydraulic unit 5 for conveying the fluid from the inlet 3 the outlet 4 and for pressurizing the fluid from the suction pressure SP such that the fluid is discharged at the outlet 4 with the discharge pressure DP. In FIG. 1 the flow of the fluid is indicated by the dashed arrows without reference numerals.

The pressure prevailing in the environment outside of the pump housing 2 is referred to as ambient pressure AP. The ambient pressure can be the atmospheric pressure. Furthermore, the ambient pressure AP can be essentially the same as the suction SP. However, depending from the particular application, the suction pressure SP can considerably differ from the ambient pressure.

The hydraulic unit 5 comprises at least one impeller 51, 52, 53 for acting on the fluid.

The pump 1 further comprises a pump shaft 6 for rotating each impeller 51, 52, 53 about an axial direction A. The axial direction A is defined by the axis of the pump shaft 6. A direction perpendicular to the axial direction A is referred to as a radial direction. The pump shaft 6 extends from a drive end 61 to a non-drive end 62. In this embodiment of the pump the drive end 61 of the pump shaft 6 is located outside of the pump housing 2 and can be connected to a drive unit (not shown) for driving the rotation of the pump shaft 6 about the axial direction A. The drive unit can comprise, for example, an electric motor. Each impeller 51, 52, 53 is mounted to the pump shaft 6 in a torque proof manner.

In the following description reference is made by way of example to an embodiment, which is suited for many applications, namely that the rotary pump 1 is configured as a multistage pump 1, wherein the hydraulic unit 5 comprises a plurality of impellers 51, 52, 53, namely at least a first stage impeller 51, a last stage impeller 52, and optionally at least one intermediate stage impeller 53, with each impeller 51, 52, 53 fixedly mounted on the pump shaft 6. The impellers 51, 52, 53 are arranged one after another on the pump shaft 6. The reference numeral 51 designates the first stage impeller, which is arranged closest to the inlet 3 for receiving the fluid with the suction pressure SP. The reference numeral 52 designates the last stage impeller 52, which is the impeller 52 closest to the outlet 4. The last stage impeller 52 pressurizes the fluid such, that the fluid is discharged through the outlet 4 with the discharge pressure DP. The reference numeral 53 designates an intermediate stage impeller 53. Each intermediate stage impeller 53 is arranged between the first stage impeller 51 and the last stage impeller 52 when viewed in the direction of increasing pressure.

The embodiment shown in FIG. 1 has nine stages, i.e. the hydraulic unit 5 comprises the first stage impeller 51, the last stage impeller 52 and seven intermediate stage impellers 53.

Of course, the number of nine stages has to be understood exemplary. The plurality of impellers 51, 52, 53 can be arranged in an in-line configuration as shown in FIG. 1 or in a back-to-back configuration. In case of embodiments of the pump 1 as a single stage pump the hydraulic unit is provided with only one impeller constituting the first stage impeller 51 or the last stage impeller 52, respectively.

The multistage rotary pump 1 shown in FIG. 1 is designed as a horizontal pump, meaning that during operation the pump shaft 6 is extending horizontally, i.e. the axial direction A is perpendicular to the direction of gravity. The rotary pump 1 shown in FIG. 1 is configured without an outer barrel casing, for example as a BB4 type pump. In other embodiments, the rotary pump 1 can be designed as a horizontal barrel casing multistage pump, i.e. as a double-casing pump.

It has to be understood that the disclosure is not restricted to this types of rotary pump 1. In other embodiments, the rotary pump can be designed for example as a vertical pump, meaning that during operation the pump shaft 6 is extending in the vertical direction, which is the direction of gravity.

The rotary pump 1 comprises bearings on both sides of the hydraulic unit 5 (with respect to the axial direction A), i.e. the rotary pump 1 is designed as a between-bearing pump. A first radial bearing 81, a second radial bearing 82 and an axial bearing 83 are provided for supporting the pump shaft 6. The first radial bearing 81 is arranged adjacent to the drive end 61 of the pump shaft 6. The second radial bearing 82 is arranged adjacent or at the non-drive end 62 of the pump shaft 6. The axial bearing 83 is arranged between the hydraulic unit 5 and the first radial bearing 81 adjacent to the first radial bearing 81. The bearings 81, 82, 83 are configured to support the pump shaft 6 both in the axial direction A and in a radial direction. The radial bearings 81 and 82 are supporting the pump shaft 6 with respect to the radial direction, and the axial bearing 83 is supporting the shaft 6 with respect to the axial direction A. The first radial bearing 81 and the axial bearing 83 are arranged such that the first radial bearing 81 is closer to the drive end 61 of the shaft 6. Of course, it is also possible to exchange the position of the first radial bearing 81 and the axial bearing 83, i.e. to arrange the first radial bearing 81 between the axial bearing 83 and the plurality of impellers 5, 51, so that the axial bearing 83 is closer to the drive end 61 of the shaft 6.

In other embodiments the axial bearing 83 can be arranged next to the second radial bearing 82, i.e. next to the non-drive end 62 of the pump shaft 6. In such embodiments the axial bearing 83 can be arranged between the hydraulic unit 5 and the second radial bearing 82 or between the second radial bearing 82 and the non-drive end 62 of the pump shaft 6.

A radial bearing, such as the first or the second radial bearing 81 or 82 is also referred to as a "journal bearing" and an axial bearing, such as the axial bearing 83, is also referred to as an "thrust bearing". The first radial bearing 81 and the axial bearing 83 can be configured as separate bearings as shown in FIG. 1, but it is also possible that the first radial bearing 81 and the axial bearing 83 are configured as a single combined radial and axial bearing supporting the shaft both in radial and in axial direction.

Usually the bearings 81, 82, 83 are provided in separate bearing housings 84, 85, which are fixedly connected to the pump housing 2. The first radial bearing 81 and the axial bearing 83 are arranged in a first bearing housing 84 arranged adjacent to the drive end 61 of the pump shaft 6. The second radial bearing 82 is provided in a second bearing housing 85 arranged adjacent to the non-drive end 62 of the pump shaft 6.

All bearings 81, 82, 83 are preferably configured as antifriction bearings, such as ball bearings. Of course, it is also possible that some or all bearings 81, 82, 83 are configured as hydrodynamic bearings.

The rotary pump 1 further comprises two sealing devices, namely a mechanical seal 7, for sealing the pump shaft 6 between the hydraulic unit 5 and the first bearing housing 84, and a second sealing device 8 for sealing the pump shaft 6 at the suction side adjacent to the first stage impeller 51 and the inlet 3. With respect to the axial direction A the second sealing device 8 is arranged between the hydraulic unit 5 and the second radial bearing 82, and the mechanical seal 7 is arranged between the hydraulic unit 5 and the axial pump bearing 83. Both the mechanical seal 7 and the second sealing device 8 seal the pump shaft 6 against a leakage of the fluid along the shaft 6 e.g. into the environment. Furthermore, by the sealing devices 7 and 8 the fluid can be prevented from entering the bearings 81, 82, 83. Preferably, the second sealing device 8 is configured as a second mechanical seal.

In other embodiments, there is no second sealing device 8 at the non-drive end 62. The second radial bearing 82 is configured as a process fluid lubricated bearing 82, which is also referred to as PLB (process lubricated bearing). The term "process fluid lubricated bearing" refers to a bearing, where the process fluid that is conveyed by the pump 1 is used for the lubrication and the cooling of the bearing 82. The bearing 82 is flooded with the fluid conveyed by the pump 1. Therefore, there is no need for a second sealing device 8.

Mechanical seals as such are well-known in the art in many different embodiments and therefore require no detailed explanation. The mechanical seal 7 is a seal for the rotating pump shaft 7 and comprises a rotor 76 fixed to the pump shaft 6 and rotating with the pump shaft 6, as well as a stationary stator 77 fixed with respect to the pump housing 2. During operation the rotor 76 and the stator 77 are sliding along each other—usually with a liquid film there between—for providing a sealing action to prevent the fluid from escaping to the environment or entering the bearing housing 84. The second sealing device 8 is configured as the second mechanical seal and comprises a second rotor 86 fixed to the pump shaft 6 and rotating with the pump shaft 6, as well as a stationary second stator 87 fixed with respect to the pump housing 2. During operation the second rotor 86 and the second stator 87 are sliding along each other—usually with a liquid film there between—for providing a sealing action to prevent the fluid from escaping to the environment or entering the bearing housing 85.

The mechanical seal 7 can be configured according to different well-known configurations, for example as a single mechanical seal or as a double mechanical seal, such as a tandem mechanical seal or a back-to-back mechanical seal.

Figure 2:
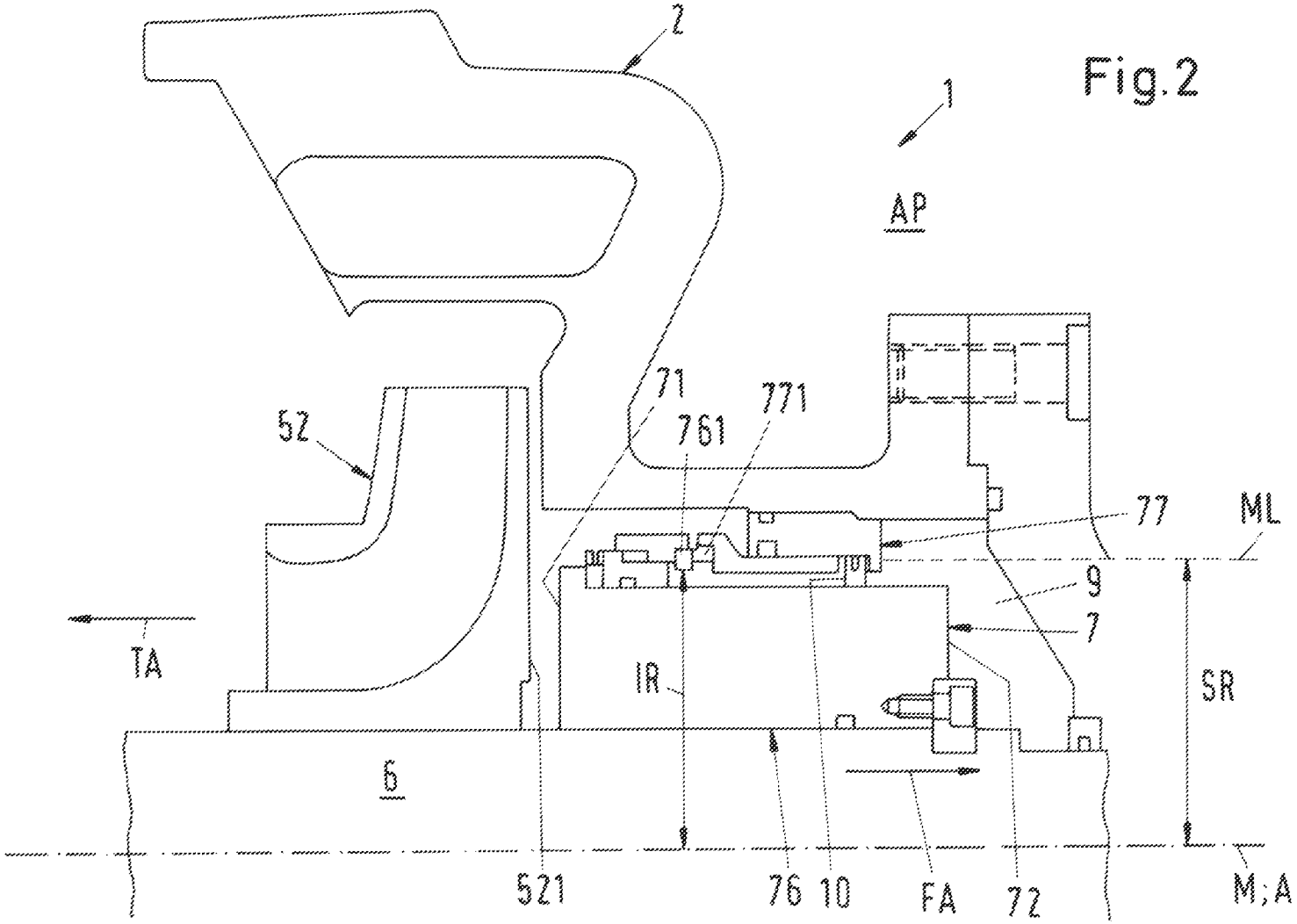
FIG. 2 is a more detailed and enlarged cross-sectional view illustrating the mechanical seal.

For a better understanding FIG. 2 shows a more detailed and enlarged cross-sectional view illustrating the mechanical seal 7.

In FIG. 2, the centerline M of the pump shaft 6 is shown. The centerline M extends in the axial direction A.

The rotor 76 of the mechanical seal 7 comprises a rotor seal ring 761 having a annular seal face. The stator 77 of the mechanical seal 7 comprises a stator seal ring 771 having an annular mating face for cooperating with the annular seal face of the rotor seal ring 761. The contact area between the seal face of the rotor seal ring 761 and the mating face of the stator seal ring 771 provides the sealing action during operation of the rotary pump 1. Usually, there is a fluid film on the contact area constituting a lubricant for the relative sliding motion between the rotor seal ring 761 and the stator seal ring 771. The fluid film can consist of the fluid which is conveyed by the rotary pump 1, or a lubricant different from the process fluid conveyed by the pump 1 is supplied to the mechanical seal 7 for forming the fluid film on the contact area, i.e. between the rotating rotor seal ring 761 and the stationary stator seal ring 771. The process fluid or the lubricant also provide for a cooling action to remove the heat which is generated by the relative movement between the rotor 76 and the stator.

Usually, the rotor seal ring 761 and/or the stator seal ring 771 are spring-loaded to pretension the annular seal face of the rotor seal ring 761 with respect to the annular mating face of the stator seal ring 771. To this end the mechanical seal 7 comprises a plurality of springs (not shown) acting on the rotor seal ring 761 and/or the stator seal ring 771.

According to the disclosure the mechanical seal is configured as a balancing device for generating an axial force FA acting on the pump shaft 6 during operation of the pump 1, wherein the axial force FA counteracts an axial thrust TA, which is generated by the hydraulic unit 5, in particular by the impeller(s) 51, 52, 53. Usually, each impeller 51, 52, 53 increases the pressure of the fluid, Thus, at the discharge side of each impeller 51, 52, 53 a pressure prevails that is larger than the pressure at the suction side of the same impeller 51, 52, 53. Therefore, each impeller 51, 52, 53 generates an individual axial thrust acting on the pump shaft, wherein the individual axial thrust is directed from the discharge side towards the suction side of the particular impeller 51, 52, 53. All the individual axial thrusts generated by the particular impellers 51, 52, 53 add up to the axial thrust TA indicated in FIG. 2.

Since the mechanical seal 7 is configured as a balancing device for generating the axial force FA directed in the opposite direction than the axial thrust TA there is no need for a separate balancing device other than the mechanical seal 7, i.e. there is no need for example for a separate balance drum or a separate balance disc as they are known from conventional rotary pumps.

In the embodiment shown in FIG. 1 and FIG. 2 the mechanical seal 7 has a sealing diameter, which is configured for balancing the axial thrust TA. In FIG. 2 the sealing radius SR of the mechanical seal 7 is shown. The sealing radius SR corresponds to half the sealing diameter. As customary in the art, the sealing diameter of the mechanical seal 7 is the diameter of the midline of the counter running faces of the rotor 76 and the stator 77. Thus, the sealing diameter is the diameter of the midline of the contact area between the seal face of the rotor seal ring 761 and the mating face of the stator seal ring 771. The location of the midline is indicated in FIG. 2 by the dashed line with the reference numeral ML. The sealing radius SR is the distance in the radial direction between the centerline M of the pump shaft 6 and the midline ML. The sealing diameter is two times the sealing radius SR.

The mechanical seal 7 is arranged adjacent to the last stage impeller 52 with respect to the axial direction A. The mechanical seal 7 has a front side 71. The front side 71 is the side facing the last stage impeller 52 of the hydraulic unit 5. Regarding the axial direction the front side 71 is arranged adjacent to a back side 521 of the last stage impeller 52, so that the front side 71 is exposed to the same pressure that prevails at the back side 521 of the last stage impeller 52. Neglecting minor pressure drops, the pressure prevailing at the back side 521 of the last stage impeller 52 is at least approximately the same as the discharge pressure DP.

The mechanical seal 7 further comprises a back side 72 which is the side facing away from the last stage impeller 52. As it can be seen in FIG. 1, the back side 72 of the mechanical seal 7 faces the bearing housing 84 or the axial bearing 83. Regarding the axial direction A, an annular chamber 9 is provided next to the back side 72 of the mechanical seal 7, i.e. the annular chamber is arranged between the mechanical seal 7 and the axial bearing 83. Thus, the back side 72 is exposed to the pressure prevailing in the annular chamber 9. Preferably, the pressure prevailing in the annular chamber 9 is the same as the suction pressure SP or the same as the ambient pressure AP, i.e. the environmental pressure prevailing outside the pump housing 2. In the embodiment of the rotary pump 1 described here, the pressure in the annular chamber 9 is at least essentially the same as the ambient pressure AP. The annular chamber 9 can be provided with a drainage opening (not shown) for discharging the fluid leaking along the contact area between the rotor 76 and the stator 77 during operation of the pump 1.

The axial force FA generated by the mechanical seal 7 results from the different pressures prevailing at the front side 71 and at the backside 72 of the mechanical seal 7. Assuming that the front side 71 is exposed to a pressure which essentially equals the discharge pressure DP and the backside to a pressure which essentially equals the suction pressure SP, the axial force FA depends on the pressure difference DP-SP and on the sealing diameter of the mechanical seal 7. Thus, by means of the sealing diameter of the mechanical seal 7 the axial force FA can be adjusted to such a value that the axial force balances the axial thrust TA generated by the hydraulic unit 5 during operation of the pump 1. The balancing can be a complete balancing of 100% or a balancing of less than 100%.

For example, the sealing diameter of the mechanical seal 7 can be configured such, that is corresponds to the diameter of the relief passage between the balance drum and the surrounding stationary part, if the same pump were configured according to the conventional design with a separate balance drum. In other words, the rotary pump according to the disclosure can be configured by removing the balance drum of a conventional rotary pump and configuring the mechanical seal 7 with the sealing diameter, which equals the diameter of the relief passage extending along the balance drum in the conventional design.

Thus, when dimensioning the mechanical seal 7 of the rotary pump 1, in particular with respect to the sealing diameter of the mechanical seal 7, the same methods, procedures or calculations can be used as they are used for dimensioning a balance drum in a conventional pump.

For many applications it is preferred that the sealing diameter is at least fifteen millimeter larger than the diameter of the pump shaft 6 at the location where the rotor 76 is arranged.

For many applications it is also preferred that the sealing diameter is at least twenty millimeters or even at least twenty-five millimeters or even thirty millimeters larger than the diameter of the pump shaft 6 at the location where the rotor 76 is arranged.

Furthermore, from the praxis it became apparent that for many applications the rotor seal ring 761 preferably has an inner diameter, which is at least fifteen millimeter larger than the diameter of the pump shaft 6 at the location where the rotor 76 is arranged.

For many applications it is also preferred that the rotor seal ring 761 has an inner diameter, which is at least twenty millimeters or even at least twenty-five millimeters or even thirty millimeters larger than the diameter of the pump shaft 6 at the location where the rotor 76 is arranged.

In FIG. 2 the inner radius IR of the rotor seal ring 761 is indicated. The inner radius IR is half the inner diameter of the rotor seal ring 761.

The preferred difference between the sealing diameter and the diameter of the pump shaft 6, or between the inner diameter of the rotor seal ring 761 and the pump shaft 6, respectively, depends on the particular application. Based on practical experience, for a diameter of the pump shaft 6, which is less or up to 120 mm, the sealing diameter or the inner diameter of the rotor seal ring 761, respectively, is preferably at least 15 mm larger than the diameter of the pump shaft 6. For a diameter of the pump shaft 6, which is larger than 120 mm the sealing diameter or the inner diameter of the rotor seal ring 761, respectively, is preferably at least 20 mm, or even at least 25 mm larger than the diameter of the pump shaft 6.

Particularly for pump shafts having a large diameter, it can be advantageous that the sealing diameter or the inner diameter of the rotor seal ring 761, respectively, is preferably at least 30 mm larger than the diameter of the pump shaft 6.

Optionally, a disaster bushing 10 can be provided for restricting the leakage of the fluid through the mechanical seal in the event of a failure of the mechanical seal 7. The disaster bushing 10 can be arranged at and fixed to the stator 77 of the mechanical seal 7. The disaster bushing 10 surrounds the rotor 76 with a small clearance and is located adjacent to the annular chamber 9.

In principle, the mechanical seal can be configured according to all known designs for mechanical seals. In particular, the mechanical seal 7 can be configured as a double mechanical seal 7, e.g. in a tandem configuration or in a back-to-back configuration or in a face-to-face configuration.

What is claimed is:

1. A rotary pump for conveying a fluid, comprising:

a pump housing with an inlet to receive the fluid having a suction pressure and an outlet to discharge the fluid having a discharge pressure;

a pump shaft configured to rotate about an axial direction;

a hydraulic unit to convey and pressurize the fluid, the hydraulic unit comprising an impeller fixedly mounted on the pump shaft, and during operation the hydraulic unit is configured to generate an axial thrust to act on the pump shaft; and a mechanical seal to seal the pump shaft, the mechanical seal including a rotor connected to the pump shaft in a torque proof manner, and a stator configured to be stationary with respect to the pump housing, and the mechanical seal being arranged between the hydraulic unit and an end of the pump shaft, and the mechanical seal being a balancing device configured to generate an axial force on the pump shaft during operation, with the axial force configured to counteract the axial thrust, a side of the mechanical seal directed towards the end of the pump shaft being exposed to atmospheric pressure, such that the mechanical seal is configured to seal against the atmosphere.

2. The rotary pump in accordance with claim 1, wherein the mechanical seal has a sealing diameter configured to balance the axial thrust generated by the hydraulic unit.

3. The rotary pump in accordance with claim 1, wherein the rotor comprises a rotor seal ring having an inner diameter which is at least 15 mm larger than a diameter of the pump.

4. The rotary pump in accordance with claim 1, wherein the mechanical seal has a sealing diameter, which is at least 15 mm larger than a diameter of the pump shaft.

5. The rotary pump in accordance with claim 1, wherein the mechanical seal is configured to seal a pressure difference, which is at least as large as a difference between the discharge pressure and the suction pressure.

6. The rotary pump in accordance with claim 1, wherein the mechanical seal has a front side facing the hydraulic unit, and a back side facing away from the hydraulic unit, the back side being the side of the mechanical seal directed towards the end of the pump shaft, and the front side is arranged adjacent to the impeller of the hydraulic unit, such that the front side of the mechanical seal is exposed to essentially a same pressure as a back side of the impeller.

7. The rotary pump in accordance with claim 6, wherein the front side of the mechanical seal is arranged to be exposed to a pressure, which is essentially a same as the discharge pressure.

8. The rotary pump in accordance with claim 6, wherein the back side of the mechanical seal is arranged to be exposed to a pressure, which is essentially a same as the suction pressure or the atmospheric pressure prevailing at an outside of the pump housing.

9. The rotary pump in accordance with claim 1, further comprising a disaster bushing configured to restrict leakage of the fluid through the mechanical seal in an event of a failure of the mechanical seal.

10. The rotary pump in accordance with claim 1, wherein the rotary pump is a multistage pump and the impeller is one of a plurality of impellers.

11. The rotary pump in accordance with claim 1, wherein the impeller is a first stage impeller, and the hydraulic unit further comprises a last stage impeller, with each of the first stage impeller and the last stage impeller fixedly mounted on the pump shaft.

12. The rotary pump in accordance with claim 11, wherein the mechanical seal is arranged adjacent to the last stage impeller with respect to an axial direction.

13. The rotary pump in accordance with claim 1, wherein the rotor comprises a rotor seal ring having an inner diameter which is at least 20 mm larger than a diameter of the pump.

14. The rotary pump in accordance with claim 1, wherein the rotor comprises a rotor seal ring having an inner diameter which is at least 25 mm larger than a diameter of the pump.

15. The rotary pump in accordance with claim 1, wherein the mechanical seal has a sealing diameter, which is at least 20 mm larger than a diameter of the pump shaft.

16. The rotary pump in accordance with claim 1, wherein the mechanical seal has a sealing diameter, which is at least 25 mm larger than a diameter of the pump shaft.

17. The rotary pump in accordance with claim 1, wherein the impeller is a first stage impeller, and the hydraulic unit further comprises a last stage impeller and an intermediate stage impeller, with each of the first stage impeller, the intermediate stage impeller and the last stage impeller fixedly mounted on the pump shaft.

* * * * *